US005199476A

United States Patent [19]

Hoden

[11] Patent Number: 5,199,476

[45] Date of Patent: Apr. 6, 1993

[54] TREATMENT OF WOOD CHIPS

[75] Inventor: Ebbe Hoden, Mariefred, Sweden

[73] Assignee: Sunds Defibrator Industries Aktiebolag, Sweden

[21] Appl. No.: 820,583

[22] PCT Filed: Sep. 4, 1990

[86] PCT No.: PCT/SE90/00564

§ 371 Date: Jan. 17, 1992

§ 102(e) Date: Jan. 17, 1992

[87] PCT Pub. No.: WO91/03595

PCT Pub. Date: Mar. 21, 1991

[30] Foreign Application Priority Data

Sep. 5, 1989 [SE] Sweden ..... 8902920

[51] Int. Cl.[5] ..... B27M 1/02

[52] U.S. Cl. ..... 144/362; 100/176; 144/2 R

[58] Field of Search ..... 72/196, 197; 100/39, 100/176; 144/2 R, 362, 255, 256, 270

[56] References Cited

U.S. PATENT DOCUMENTS

| | | | |
|---|---|---|---|
| 266,763 | 10/1882 | Burk | 144/362 |
| 1,150,805 | 8/1915 | Beran | 72/197 |
| 3,447,352 | 6/1969 | Millen | 72/196 |
| 4,319,473 | 3/1982 | Franke, Jr. et al. | 72/196 |
| 5,007,271 | 4/1991 | Boegli | 72/196 |

*Primary Examiner*—W. Donald Bray
*Attorney, Agent, or Firm*—Lerner, David, Littenberg, Krumholz & Mentlik

[57] ABSTRACT

For the purpose of faciliating the impregnation of wood chips, the chips are compressed between two compression devices (9) which act on the mutually opposing flat sides of the chips (2). As the chips are compressed, the chips (2) are undulated or curved in at least one direction to produce a wave shape such that when the chips are seen in section at right angles to the waves, the top and the bottom sides (15, 16) of the wave crests will both be located on one side of a central plane (19) which passes through respective chips between the bottom sides (16) of the wave crests and the top sides (17) of the wave troughs, whereas the top and bottom sides (17, 18) of the wave troughs will both be located on the other side of the central plane (19). Apparatus for use in treating wood chips in this way includes compression devices (9) which present surfaces which are intended to act on the flat sides of the chip pieces (3) in a manner to form an undulating wave-shaped pattern which extends in at least one direction such that when in a chip-compression position the wave crests (13) on each compression device (9) will meash with the wave troughs(14) defined by mutually adjacent wave crests (13) on the opposite compression device (9).

6 Claims, 2 Drawing Sheets

TREATMENT OF WOOD CHIPS

FIELD OF THE INVENTION

The present invention relates to the field of treating wood chips prior to their impregnation.

BACKGROUND OF THE INVENTION

Impregnation of wood chips prior to the manufacture of pulp therefrom, either chemically or semi-chemically, or prior to producing pulp mechanically from said chips, for instance in a disc refiner, can be made easier and improved by compressing the chips between rotating rollers. See CA 773,835. The wood chips preferably contain 40–55 percent by weight water and are compressed to a thickness of from 1/5–1/10 of their original thickness in the roll nip defined between a pair of rollers. The rollers act on the mutually opposite flat sides of the chips to loosen the bonds between the fibres and to render the chips more porous. The chips return almost to their original shape subsequent to compression.

Thicker chips are compressed more thoroughly than thinner chips between the rollers. This results in an increase in the porosity of the thicker chips, so as to render the entire cross-section of the thicker chips accessible to an impregnating liquid and to achieve comparatively uniform impregnation. The thinner chips do not benefit from as high a degree of compression and have a lesser increase in porosity. Infeed of the chips into the roll nip can be made easier by roughening the roller surfaces.

WO 89/02951 relates to improving uniformity during the impregnating process. This is accomplished by sawing mutually identical wood pieces having a length of, e.g., 100 mm in the fibre direction and a width and thickness of 40×10 mm transversely to the fibre direction, and compressing the wood pieces at right angles to the fibre direction prior to impregnation. For instance, the wood pieces can be compressed between rollers or press plates which act on the mutually opposite flat sides of said wood pieces. When rollers are used, the rollers may be shallowly serrated or fluted, so as to facilitate movement of the wood pieces into the roll nip.

OBJECTS AND SUMMARY OF THE INVENTION

The object of the present invention is to provide a novel and advantageous method for treating wood chips prior to impregnation. The method will impart greater porosity and liquid-absorption properties to the chips.

It is another object of the present invention to provide an apparatus capable of compressing chips so as to impart greater porosity and liquid-absorption properties to the chips.

In accordance with these objections and in one aspect of the present invention there is provided a method of treating a plurality of wood chips, the wood chips having an average thickness ranging between a low average thickness and a high average thickness, prior to impregnating the plurality of wood chips, including the steps of: providing a plurality of wood chips; and compressing the plurality of wood chips to an average thickness which is less than the low average thickness without damaging fibers of the wood chips and while imparting to the plurality of wood chips an undulating configuration in at least one direction so as to produce a plurality of wave-shaped wood chips having at least one wave crest and at least one wave trough, the wood chips thereby having greater porosity and liquid absorption properties.

There is also provided an apparatus for compressing a plurality of wood chips having an average thickness ranging between a low average thickness and a high average thickness, so as to improve their porosity and liquid absorption properties including: a plurality of compression rolls, the compression rolls including a plurality of grooves and being disposed relative to each other so as to compress the plurality of wood chips to an average thickness which is less than the low average thickness without damaging fibers of the wood chips and so as to impart to the plurality of wood chips an undulating configuration and in least one direction so as to produce a plurality of wave-shaped wood chips having at least one wave crest and at least one wave trough, the apparatus capable of producing wood chips having greater porosity and liquid absorption properties.

To these ends, it is proposed, in accordance with the present invention, that when carrying out these methods the wood chips are given a curved or undulating configuration in at least one direction in conjunction with compressing said chips. This results in a wave-shape such that when the chips are seen in cross section perpendicular to the waves, the top and the bottom sides of the wave crests will both be located on one side of a central plane which extends through respective chips between the bottom side of the wave crests and the top side of the wave troughs, and the top and bottom sides of the wave troughs will both be located on the other side of said central plane. Put another way, the resulting wave-shaped wood chips have at least one wave crest and at least one wave trough. Each includes a top side and a bottom side. The central plane defined by each wood chip also has a first side and a second side. The central plane extends through the wood chip such that the bottom side of the crest and the top side of the trough are disposed on opposite sides of said central plane. As a result of this method, as the chip pieces are compressed they are subjected to treatment which further loosens the bonds between the fibres and therewith greatly increases the liquid absorbency of the chips.

The invention also relates to the use of an apparatus which comprises two mutually coacting compression devices, preferably in the form of compression rolls. These rolls include surfaces that are so undulated or wave-shaped in at least one direction such that when placed that in a chip-compressing position, the wave crests of each compression device will protrude into or mesh with the wave troughs defined between mutually adjacent wave crests on the opposing compression device.

BRIEF DESCRIPTION OF THE DRAWINGS

Further characteristic features of the invention and other advantages afforded thereby will be evident from the claims and from the following description of an exemplifying embodiment of the inventive apparatus illustrated in the accompanying drawings.

DETAILED DESCRIPTION OF THE PREFERRED EMBODIMENT

Figure 1:
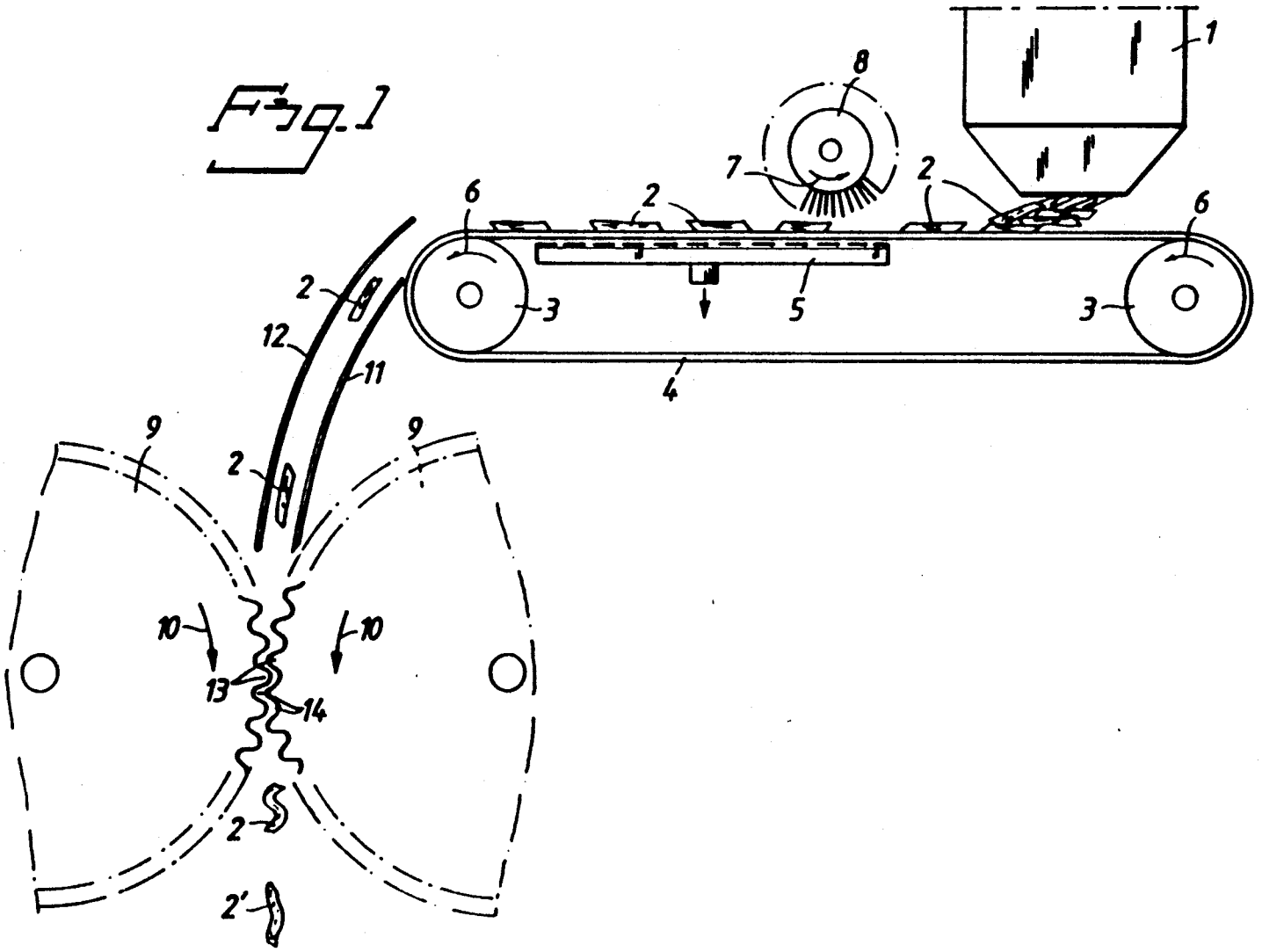
FIG. 1 is a side view, partly in section, of a schematically illustrated apparatus for use when carrying out the inventive method.

In FIG. 1, the reference numeral 1 identifies a conventional wood-chip hopper, from which chips 2 are fed onto the upper part of an endless conveyor belt 4 extending around guide rollers 3. The belt 4 is permeable to air. Mounted beneath the upper part or run of the belt 4 is a subpressure source (not shown), for instance a suction box 5 which is connected to the suction side of a fan, by means of which the chips are held firmly to the upper run of the belt 4 by suction, said upper run being caused to move from right to left in FIG. 1 by means of a drive motor (not shown), as indicated by the arrows 6. Mounted immediately above the upper run of the conveyor belt is a brush roller 8 which rotates in a counterclockwise direction, as shown by the arrow 7. The brush roller 8 functions to ensure that only a single layer of chips, lying on one flat side thereof, will be transported over the suction box 5, so as to be introduced into the nip between two mutually co-acting compression devices. A preferred compression device includes a pair of cooperating rolls 9, located at the delivery end of the conveyor belt 4. The rolls 9 are rotated in the direction of the arrows 10, in mutually opposite directions, by means of a drive device (not shown) and chips 2 are fed and fall into the nip defined between said rolls 9 downwardly, e.g., into a storage hopper (not shown) or an impregnating vessel (not shown) beneath said nip. Arranged between the delivery end of the conveyor belt 4 and the roll nip is a guide means which is indicated by curved guide plates 11, 12 and which ensures that prior to entering the roll nip, the chips 2 will be oriented such that the rolls 9 will act on mutually opposing flat sides of the chips 2.

The surfaces of the rolls 9 or compression devices intended to act upon the flat sides of the chips are undulated in a pattern such that the wave crests 13 of each compression device 9 in a compressing position intended for the treatment of said chips will protrude into the wave troughs 14 defined between mutually adjacent wave crests 13 on the opposing compression device, as clearly shown in FIG. 1.

In the case of the FIG. 1 embodiment, the surfaces of the rollers 9 have been made undulating by forming groove therein in substantially the longitudinal direction of rolls 9. Alternatively, the grooves may be extended at any desired angle relative to said longitudinal direction. For instance, the grooves can extend peripherally, in which case the rolls 9 may be drive at mutually different rotational speeds. The rolls 9 may also be provided with grooves which extend in two directions at angles to one another. These angles are preferably from 45° to 90°. The waves or undulations forming said wave pattern are preferably distributed uniformly with a pitch of 5–13 mm, preferably a pitch of 6–11 mm, and more preferably 7–9 mm. The wave height should be at least one quarter and preferably at least substantially equal to half the pitch.

Although the compression devices illustrated and described with reference to the accompanying drawing have the form of rolls 9, it will be understood that the compression devices may have any desired configuration within the scope of the protection claimed, for instance said devices may have the form of mutually opposing press plates provided with mutually coacting groove patterns.

Figure 2:
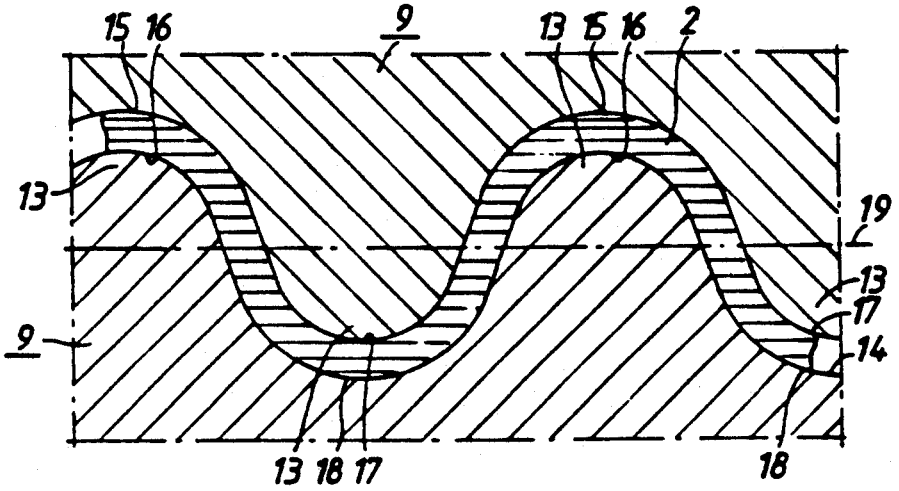
FIG. 2 is a fragmentary, sectional view in larger scale which shows mutually coacting parts of two compression devices for use when treating wood chips in accordance with the invention.

FIG. 2 illustrates parts of two compression devices 9 disposed in a compressing position. Located in a wave-shaped gap between the devices 9 is a chip 2 which has been compressed in accordance with the present invention and which is shown in cross section taken at right angles to the waves. In conjunction with a compressing operation, in which the devices 9 move towards one another and are caused to act on mutually opposite flat sides of the chip 2, the chip is clamped between the crests 13 and troughs 14 of the wave patterns or undulations on mutually opposite devices 9 and is curved or undulated by said crests 13 and troughs 14 while, at the same time, being stretched to a corresponding wave-shape. Viewed in cross section at right angles to the waves, the top and bottom sides 15, 16 of the wave crests formed in the chip will both be located on a first side of a central plane 19 which passes through the center of the chip. The top and bottom surfaces 17, 18 of the wave troughs are located on the second side of said plane.

In addition to being compressed, the degree of chip-compression being adjusted by suitable adjustment of the final gap width and/or the final compressing pressure, the chip 2 is also considerably stretched, which increases its ability to absorb liquid in a subsequent impregnating stage. The final gap width or the final compressing pressure is selected so as not to damage the fibres of the chips 2, e.g. so that the gap width will be about 1/5 to 1/15 of the average thickness of the chips, measured between the flat sides of said chips, and so that the final compressing pressure will not exceed 30 MPa. The chip pieces 2 are assumed to have conventional dimensions, for instance an average thickness of between a low average thickness and a high average thickness, generally ranging from between about 3 and about 7 mm, and a conventional shape such as that described in many passages of the literature relating to cellulose techniques.

The chips 2 treated in the aforedescribed manner will return to their original shape, at least to a certain extent, as shows at 2' in FIG. 1. The compressed chips, whoever, will have a markedly improved liquid absorbency in comparison both with non-treated chips and chips which have been compressed in some other way.

EXAMPLE 1

Figure 3:
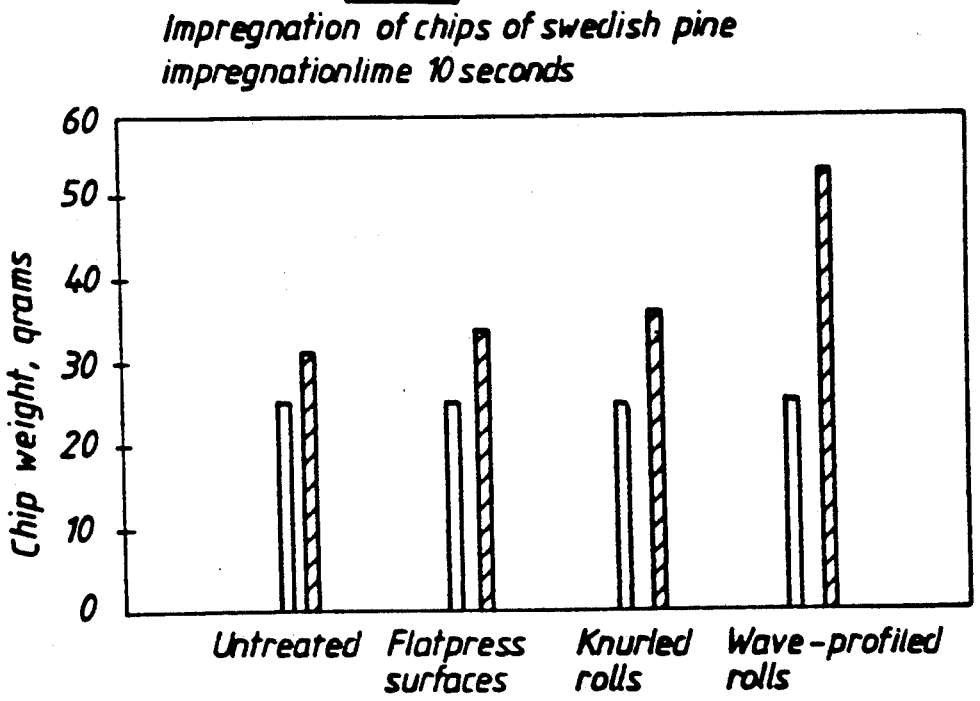
FIG. 3 is a diagram which shows the results obtained when impregnating non-treated chips and chips which had been compressed in various ways prior to being impregnated.

FIG. 3 illustrates the result of impregnating with water non-treated chips and chips subjected to a compression force of 10 MPa. The results constitute the average of batches of eight tests with a chip-impregnating time of 10 seconds. The percentages recited below are percentages by weight. The chips had an average weight of 25 g in all cases, of which water was responsible for about 50%.

It will be seen from FIG. 3 that the non-treated chips absorbed about 6 g of impregnating liquid, i.e. their dry content was reduced from about 50% to about 40%.

The chips treated between flat press surfaces absorbed about 9 g of impregnating liquid, i.e. the dry content of the chips was reduced from about 50% to about 37%. The chips which were pressed between rolls which had been serrated or knurled to facilitate introduction of the chips into the roll nip absorbed about 11 g of the impregnating liquid, i.e. the dry content of the chips was reduced from about 50% to about 35%.

The wave-profiled rolls used in the impregnating test were both wave-profiled in two mutually perpendicular directions at a wave pitch of about 8 mm and a wave height of about 4 mm. The chips absorbed about 29 g of impregnating liquid, i.e. the dry content of the chips was reduced to only about 23%.

EXAMPLE 2

A second test was carried out in which the rolls used were grooved in only one direction (the waves extended substantially parallel with the axes of the rolls, as shown in FIG. 1), with a wave pitch of about 7.8 mm and a wave height of about 3.9 mm and a pressure of about 10 MPa. Chips having a dry content of about 50% were rolled in mutually different directions and the following results were obtained when submersing the rolled chips in water for a period of 10 seconds.

Chips that were rolled at right angles to the fibre direction absorbed about 100% water, i.e. their dry content fell from about 50% to about 25%.

Chips that were rolled parallel with the fibre direction absorbed about 76% water, i.e. their dry content fell from about 50% to about 28%.

Chips that were rolled at a angle of about 45° to the fibre direction absorbed about 86% water, i.e. their dry content fell from about 50% to about 27%.

Continued impregnation of the chips for a further 10 seconds resulted in only a marginal increase in the amount of water absorbed.

It is evident from the above results that a good impregnating result is obtained even with rolls that are grooved solely in one direction. It will be understood that correspondingly good results are obtained when impregnating wood chips in conventional pulping solutions.

If it is desired to undulate the chips in two directions which form an angle with one another, the chips can be passed twice through a roll pair with rolls grooved in one direction, or the chips may be passed through two sequential pairs of rolls grooved in one direction.

It will be understood that the invention is not restricted to the described and illustrated exemplifying embodiments thereof, and that the invention can be realized in any desired manner within the scope of the inventive concept defined in the following claims.

I claim:

1. A method of treating a plurality of wood chips, said wood chips having an average thickness ranging between a low average thickness and a high average thickness prior to impregnating said plurality of wood chips comprising the steps of:

providing said plurality of wood chips; and compressing said plurality of wood chips to an average thickness which is less than said low average thickness without damaging fibers of said wood chips and while imparting to said plurality of wood chips an undulating configuration in at least one direction so as to produce a plurality of wave-shaped wood chips having at least one wave crest and at least one wave trough, said wood chips thereby having greater porosity and liquid absorption properties.

2. The method of claim 1, wherein said at least one wave crest includes a top side and a bottom side and said at least one wave trough includes a top side and a bottom side and wherein said wood chips define a central plane having a first side and a second side, said central plane extending through said wood chips such that said bottom side of said at least one wall crest is disposed on a first side of said central plane and said top side of said at least one wave trough is disposed on a second side of said central plane.

3. The method of claim 1, wherein said undulating configuration is imparted by compressing said wood chips between at least one pair of grooved rolls.

4. The method of claim 1, wherein said at least one wave crest and said at least one wave trough are uniformly distributed with a pitch of between about 5 and 13 mm and a height substantially equal to half said pitch.

5. The method of claim 1, wherein said wood chips are imparted with an undualting configuration in a plurality of directions disposed at an angle ranging from between about 45° to about 90° relative to one another.

6. An apparatus for compressing a plurality of wood chips having an average thickness ranging between a low average thickness and a high average thickness so as to improve their porosity and liquid absorption properties comprising: a plurality of compression rolls, said compression rolls including a plurality of grooves and being disposed relative to each other so as to compress said plurality of wood chips to an average thickness which is less than said low average thickness without damaging fibers of said wood chips and so as to impart to said plurality of wood chips an undulating configuration and in least one direction so as to produce a plurality of wave-shaped wood chips having at least one wave crest and at least one wave trough, said apparatus capable of producing wood chips having greater porosity and liquid absorption properties.

* * * * *

UNITED STATES PATENT AND TRADEMARK OFFICE

CERTIFICATE OF CORRECTION

PATENT NO. : 5,199,476

DATED : April 6, 1993

INVENTOR(S) : Hoden

It is certified that error appears in the above-identified patent and that said Letters Patent is hereby corrected as shown below:

On the title page, in the Abstract, third line up from the bottom, "will meash" should read --will mesh--.

Column 2, line 16, "in least" should read --in at least--.

Column 3, line 56, "may be drive" should read --may be driven--.

Column 4, lines 46-47, "whoever" should read --however--.

Column 4, lines 65-66, close gap between "content" and "of the chips".

Column 5, line 27, "rolled at a angle" should read --rolled at an angle--.

Column 6, line 32, "undualting" should read --undulating--.

Column 6, line 46, "in least" should read --in at least--.

Signed and Sealed this

Twenty-fifth Day of January, 1994

*Attest:*

Bruce Lehman

BRUCE LEHMAN

*Attesting Officer*

*Commissioner of Patents and Trademarks*